United States Patent [19]

Schmidt et al.

[11] Patent Number: 4,569,617

[45] Date of Patent: Feb. 11, 1986

[54] PILE CONSTRUCTION

[75] Inventors: Bertil Schmidt, Oxelösund; Pentti Kosonen, Saltsjö-Boo, both of Sweden

[73] Assignee: Aktiebolaget Gustavsberg, Gustavsberg, Sweden

[21] Appl. No.: 646,025

[22] Filed: Aug. 29, 1984

Related U.S. Application Data

[63] Continuation of Ser. No. 435,343, Oct. 19, 1982, abandoned, which is a continuation of Ser. No. 217,039, Dec. 16, 1980, abandoned.

[30] Foreign Application Priority Data

Jun. 17, 1980 [SE] Sweden ..... 7910468

[51] Int. Cl.[4] ..... E02D 5/08; E02D 5/22; F16L 25/00

[52] U.S. Cl. ..... 405/251; 405/231; 285/332

[58] Field of Search ..... 405/231, 250, 251, 252, 405/253, 254; 285/332, 382, 382.1, 382.2; 52/726

[56] References Cited

U.S. PATENT DOCUMENTS

| | | | |
|---|---|---|---|
| 1,776,615 | 9/1930 | Boothman et al. | 285/332 X |
| 2,011,459 | 8/1935 | Snow et al. | 405/253 |
| 2,452,219 | 10/1948 | Bergvall et al. | 285/332 X |
| 2,457,908 | 1/1949 | Meyerhoefer | 285/332 X |
| 3,030,544 | 4/1962 | Zamboldi et al. | 285/332 X |
| 3,199,300 | 8/1965 | Fiore | 285/332 X |
| 3,263,431 | 8/1966 | Phares | 405/251 |
| 3,616,866 | 11/1971 | Verheul | 285/332 X |
| 4,269,438 | 5/1981 | Ridenour | 285/382.2 |

*Primary Examiner*—Cornelius J. Husar
*Assistant Examiner*—Nancy J. Stodola
*Attorney, Agent, or Firm*—Toren, McGeady, Stanger, Goldberg & Kiel

[57] ABSTRACT

The invention relates to a pile construction comprising a number of steel tube sections (1) that are joined together. Each tube section (1) is formed with joining portions (2, 4) in its respective ends. One joining portion is constituted by a male end (2) having a conical envelope surface (3) and the other portion by a socket end (4), the interior surface (5) of which is conical in correspondence to the conicity of the male end (2). When the tube sections (1) are joined the male end (2) of one section interacts with the socket end (4) of the next section, so that a stiff joint is obtained.

1 Claim, 2 Drawing Figures

PILE CONSTRUCTION

This is a continuation of application Ser. No. 435,343, filed Oct. 19, 1982, now abandoned, which is a continuation of application Ser. No. 217,039, filed Dec. 16, 1980, now abandoned.

The present invention relates to a pile construction comprising a plurality of separate and distinct steel tube sections, which by being formed with male and female portions at their respective ends are adapted to be readily stacked end to end, one on the other, to form a continuous pile of a predetermined length.

Such pile constructions can be used for foundation reinforcement when building houses and similar objects. For this purpose the piles are driven through the ground until they strike the rock base. Sometimes friction piles are used, which do not need to be driven down to the rock base.

One serious problem about joining separate tube sections to long piles is to obtain a joint with a sufficient stiffness, so that a relative displacement of adjacent tube sections is prevented. A further problem is to prevent corrosion damage on the pile. As the pile is driven through the ground its corrosion protection layer is scraped off by the material in the hole around the pile. In particular the part of the pile that penetrates the ground water level will thereby be exposed to the risk of corrosion damage.

Several different types of joining devices to connect pile sections have been proposed. Such a joining device may consist of a coupling body, that is attachable to a pile section. This coupling body has coupling details mounted thereon. One type of joining device comprises a flat contact surface, which is disposed in a right angle towards the longitudinal axis of the pile. When two pile sections, each having a coupling body as described above, are connected these contact surfaces are brought to a rigid contact with each other. The known joining devices have in common that they are expensive and sometimes sensitive to damage or difficult to apply.

It is an object of this invention to provide improved pile joints, that fulfil the requirement of stiffness and the shape of which makes possible that a transfer of forces is obtained to a sufficient extent. The shape of the joint makes also possible a fast and simple connection of the separate tube sections. Furthermore the risk of corrosion damage on the driven pile is reduced.

SUMMARY OF THE INVENTION

Briefly, the present invention may be described as a pile construction which is formed by stacking end-to-end a plurality of generally identically formed steel tube sections. Each of the tube sections is formed with a male end and a socket end with the male end of one tube section being inserted into the socket end of an adjacent tube section to form the pile construction. The male end is formed with an outer surface having a conical configuration which is adapted to engage a conical configuration of an inner surface of the socket end of each tube section. Each of the tube sections extends from the outer surface of the male end to a contiguous outer surface of the socket end, with the outer surface of the socket end being wider than the outer surface of the male end whereby as each tube section is inserted into a ground formation, a widened opening will be formed for successive tube sections.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
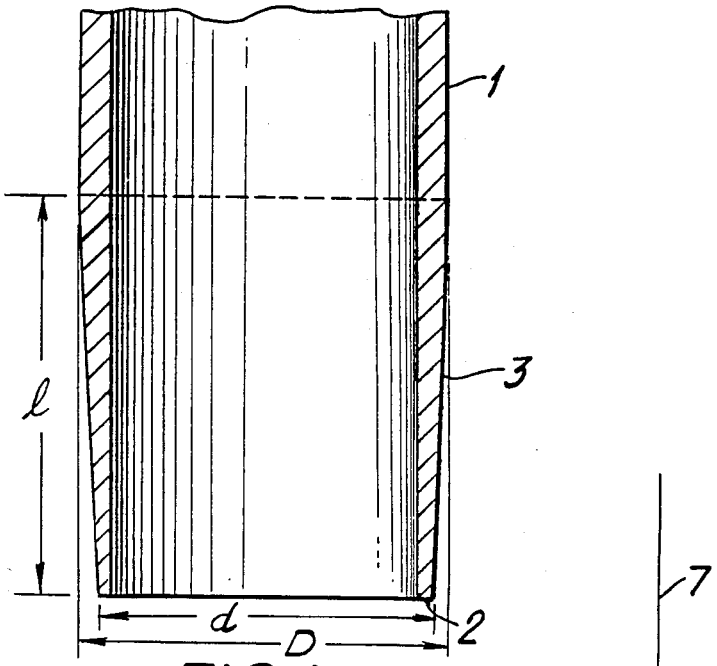
FIG. 1 is a cross-section of the male end of a tube section.

Each tube section 1 that is comprised in the pile construction is formed with a joining portion when the tube section is cast. One of the ends is formed as a male end 2, the outer surface 3 of which is conical inwards towards the centre of the section 1 towards its end. The other end of the tube section 1 is formed as a socket 4, being wider than the remaining part of the section. The interior surface 5 of the socket is conical inwards towards the centre of the section 1 from its end. The conicity of the socket 4 corresponds to that of the male end 2. The socket end 4 of the tube section 1 is furthermore provided with a shoulder 6, the purpose of which will become evident in the following. Reference numeral 7 refers to the driving direction of the pile.

Figure 2:
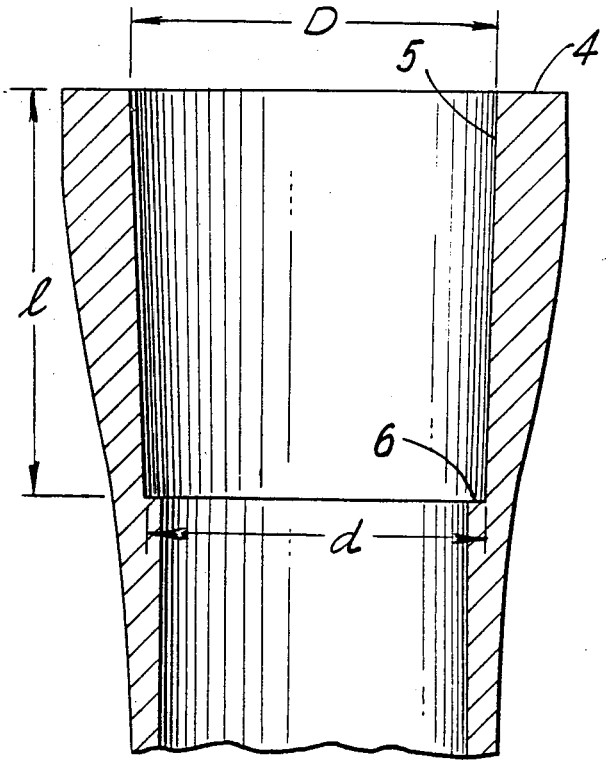
FIG. 2 is a cross-section of the socket end of a tube section.

When the pile is driven through the ground the conical contact surface 3 of the male end 2 of each tube section 1 interacts with the conical socket end 5 of the preceding section 1 in the driving direction 7. The pile is composed of the number of tube sections 1 that are required to reach the rock base. The normal length of a tube section is 5 meters. The shape of the joint makes possible a sufficient stiffness of the pile even when using several tube sections 1. By means of the conical contact surfaces 3, 5 a correct joint between the sections is obtained, said joint being of such a nature that a sufficient transfer of forces is made possible. To obtain this purpose the conicity rate of taper must be so small that self-locking is obtained. In a preferred embodiment of the invention the conicity is 1:15. Conicity is defined as the degree or rate of taper of the parts which is equivalent to the larger diameter (D) of the conical taper minus the smaller diameter (d) divided by the length (l) therebetween (conicity$=(D-d)/l$). As will be seen from FIGS. 1 and 2, the conical surfaces 3 and 5 are each formed to extend over a length l between a larger diameter D and a smaller diameter d, each having a conicity or rate of taper of 1:15.

Since the socket end 4 is wider than the remaining part of each tube section, the tube section that is first driven through the ground will create a hole, which is wider than the tube section 1. This means that the subsequent tube section can be driven through the ground without its principle envelope surface getting in contact with the ground material. It is thus avoided that the corrosion protection layer is scraped off. In this way a sufficient corrosion protection for the pile is obtained. This is of particular importance for the part of the pile that penetrates the ground water level, said part being particularly exposed to corrosion. After the pile has been driven to a stop, the ground material will be pressed to contact with the pile due to the pressure in the ground.

When the pile strikes the rock base, the male end 2 is driven against the shoulder 6 in the socket end 4 without eliminating the conical contact.

While a specific embodiment of the invention has been shown and described in detail to illustrate the application of the inventive principles, it will be understood that the invention may be embodied otherwise without departing from such principles.

We claim:

1. A pile construction system comprising:

a plurality of piles, each of said piles having a generally identical tubular configuration with each being adapted to be inserted one within the other to form a complete piling system;

each of said piles having a male end and a socket end, with the male end of each one of said piles being adapted to be inserted into the socket end of any other pile of said system;

an outer envelope surface extending from said male end and an interior surface extending from said socket end, said outer envelope surface of said male end and said interior surface of said socket end both having a conical configuration with a rate of taper of approximately 1:15, said piles being shaped such that when said piles are joined end-to-end, each of said outer envelope surfaces are engaged respectively in tight press fitted engagement within one of said interior surfaces thereby to obtain a joint between said piles; and a shoulder formed at said interior surface spaced a distance from said socket end defining the innermost termination of said conical configuration of said interior surface, said shoulder having the terminal part of said male end in abutting engagement thereagainst when said piles are interconnected to form said piling system;

each of said piles being formed with the greatest wall thickness thereof at said socket ends and gradually increasing in wall thickness from said shoulder to said socket end, with the portions of each of said piles other than at said socket ends having a wall thickness which is less than the wall thickness of said socket ends along the entire length thereof.

* * * * *